US012702891B2

(12) United States Patent
Rudd et al.

(10) Patent No.: US 12,702,891 B2
(45) Date of Patent: Aug. 11, 2026

(54) DUMBBELL WITH ROUNDED RIMS

(71) Applicant: Nike, Inc., Beaverton, OR (US)

(72) Inventors: Gabrielle A. Rudd, Lake Oswego, OR (US); Andrew P. Conant, Lake Oswego, OR (US)

(73) Assignee: NIKE, INC., Beaverton, OR (US)

( * ) Notice: Subject to any disclaimer, the term of this patent is extended or adjusted under 35 U.S.C. 154(b) by 104 days.

(21) Appl. No.: 18/784,074

(22) Filed: Jul. 25, 2024

(65) Prior Publication Data

US 2025/0073522 A1 Mar. 6, 2025

Related U.S. Application Data

(60) Provisional application No. 63/580,029, filed on Sep. 1, 2023.

(51) Int. Cl.
*A63B 21/072* (2006.01)
*A63B 71/00* (2006.01)

(52) U.S. Cl.
CPC ..... *A63B 21/0726* (2013.01); *A63B 71/0054* (2013.01)

(58) Field of Classification Search
CPC ..... A63B 21/0726; A63B 21/0728; A63B 21/075; A63B 2220/17
See application file for complete search history.

(56) References Cited

U.S. PATENT DOCUMENTS 7,491,156 B1 * 2/2009 Gao ..... A63B 21/0724 482/106
D962,364 S * 8/2022 Lin ..... D21/681
D962,365 S * 8/2022 Lin ..... D21/681
D963,078 S * 9/2022 Henniger ..... D21/681
D982,683 S * 4/2023 Lin ..... D21/681
2014/0005013 A1* 1/2014 Kassemi ..... A63B 21/4035 482/108
2019/0126124 A1* 5/2019 Vigiano ..... A63B 21/4035
2022/0062693 A1* 3/2022 Martinez ..... A63B 21/4035
2022/0111243 A1* 4/2022 Flom ..... A63B 21/072
2023/0414987 A1* 12/2023 Flom ..... A63B 21/072

OTHER PUBLICATIONS

Amazon Basics Neoprene Coated Hexagon Workout Dumbbell Hand Weight, Amazon.com, no date but published before Jul. 10, 2024, retrieved from https://www.amazon.com/AmazonBasics-Pound-Neoprene-Dumbbells-Weights/dp/B01LR5S6HK/ref=asc_df_B01LR5S6HK (8 pages).

* cited by examiner

*Primary Examiner* — Andrew M Kobylarz
(74) *Attorney, Agent, or Firm* — Bookoff McAndrews PLLC

(57) ABSTRACT

The present disclosure includes an article of exercise equipment, such as, to a dumbbell having an ergonomic design. In some embodiments, the dumbbell may comprise an exposed metal handle having a central longitudinal axis extending through the handle; two heads located at opposite ends of the handle, with each of the heads including an outer end face and an inner end face positioned closer to the handle than the outer end face, and a plurality of side faces disposed between the outer end face and the inner end face; and a plurality of rims. Each of the plurality of side faces may face radially outward away from the central longitudinal axis, and each rim of the plurality of rims may include a fillet.

19 Claims, 5 Drawing Sheets

DUMBBELL WITH ROUNDED RIMS

CROSS-REFERENCE TO RELATED APPLICATION(S)

This patent application is a continuation of and claims the benefit of priority to U.S. Application No. 63/580,029, filed on Sep. 1, 2023, the entirety of which is incorporated herein by reference.

FIELD

The present disclosure relates generally to an article of exercise equipment, and more particularly, to a dumbbell having an ergonomic design.

BACKGROUND

Dumbbells are a type of free weight used in weight training. Due to their effectiveness and versatility, dumbbells are used by amateur and professional athletes alike. In recent years, functional fitness has increased in popularity, resulting in dumbbells being used in increasingly different ways. For example, dumbbell front squats are an exercise typically performed with the user resting one dumbbell on each shoulder. Different athletes utilize various placements of the dumbbell onto their shoulders to improve comfort and/or performance. For example, a user may place one head of the dumbbell on the shoulder in a horizontal or vertical orientation. Still other users may rest the handle of the dumbbell on the shoulder so that the two heads of the dumbbell surround the shoulder in the anterior/posterior directions.

The device of the present disclosure may solve one or more of the problems set forth in the art. The scope of the current disclosure, however, is defined by the attached claims, and not by the ability to solve any specific problem.

SUMMARY

The present disclosure includes a dumbbell comprising: an exposed metal handle having a central longitudinal axis extending through the handle; two heads located at opposite ends of the handle, with each of the heads including an outer end face and an inner end face positioned closer to the handle than the outer end face, and a plurality of side faces disposed between the outer end face and the inner end face; and a plurality of rims. Each of the plurality of side faces may face radially outward away from the central longitudinal axis. One of the plurality of rims may be disposed at each interface of: (a) the outer end face and each of the plurality of side faces of a given head; (b) the inner end face and each of the plurality of side faces of a given head; and (c) circumferentially adjacent side faces. Each rim of the plurality of rims may include a fillet.

In some embodiments, the two heads of the dumbbell may not include any straight edges at the interface of: (a) the outer end face and each of the plurality of side faces of a given head; (b) the inner end face and each of the plurality of side faces of a given head; and (c) circumferentially adjacent side faces. Each of the two heads may include a metal core, and a rubber cover, wherein the plurality of rims may be formed in the rubber cover of a given head. The outer end face and the inner end face may be substantially planar. Each head may include six side faces. Each head may include a substantially hexagonal cross-section. An arc length of each rim of the plurality of rims may be from 3-8 degrees, and the arc length may be measured about a polar axis. The polar axis may have a center point along a central longitudinal axis extending through the handle and the two heads. The arc length of each rim may measure between a first tangent to a first side face of the plurality of side faces, and a second tangent to a second side face of the plurality of side faces. The first side face and the second side face may be circumferentially adjacent to one another. The outer end face and the inner end face may substantially planar. A majority of the plurality of side faces may be substantially planar. For each of the two heads, one of the plurality of side faces may include an indentation. Rounded corners may be disposed at the interface of two circumferentially adjacent side faces and the outer end face. Rounded corners may be disposed at the interface of two circumferentially adjacent side faces and the inner end face. Each head may include twelve rounded corners. Each head of the dumbbell may not include any sharp corners. The dumbbell may have a weight of at least 5 pounds. The dumbbell may have a weight of at least 25 pounds. The dumbbell may have a weight from 35 pounds to 100 pounds.

The present disclosure also includes a dumbbell comprising: an exposed metal handle having a central longitudinal axis extending through the handle; two heads located at opposite ends of the handle, each of the heads including: an outer end face, an inner end face positioned closer to the handle than the outer end face, and a plurality of side faces disposed between the outer end face and the inner end face. Each of the plurality of side faces may face radially outward away from the central longitudinal axis, wherein each of the following interfaces within each of the two heads includes a rounded edge: (a) the outer end face and each of the plurality of side faces of a given head; (b) the inner end face and each of the plurality of side faces of a given head; and (c) circumferentially adjacent side faces.

The present disclosure also includes a dumbbell comprising: an exposed metal handle having a central longitudinal axis extending through the handle; and two rubber-coated heads located at opposite ends of the handle. Each head may include six outer side faces extending around a circumference of the given head, and no interface between circumferentially adjacent faces has a straight edge or straight corner.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects, or proportions as shown in the figures.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
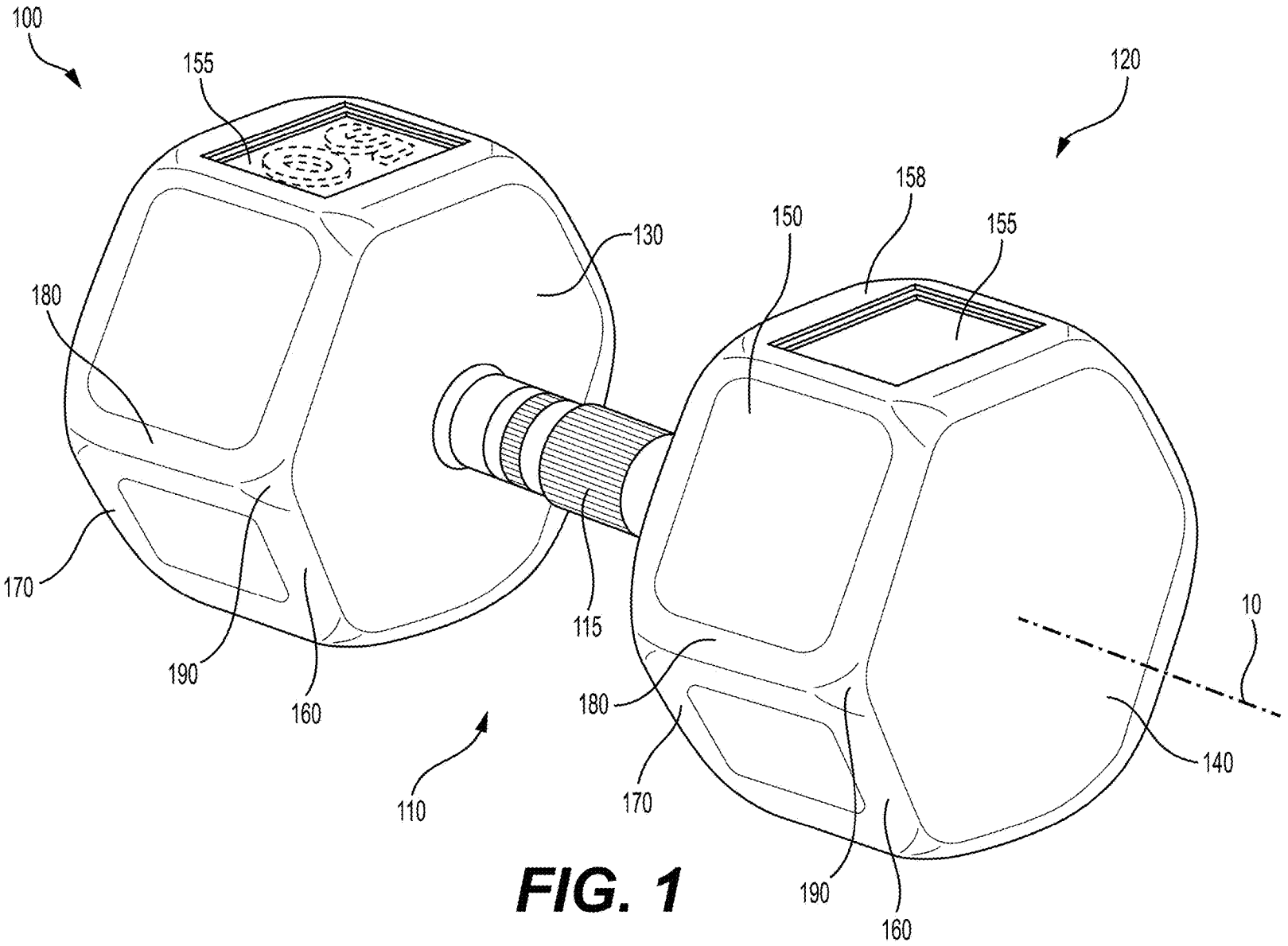
FIG. 1 is a perspective view of an exemplary dumbbell, according to aspects of the disclosure.

FIG. 1 depicts an exemplary dumbbell 100, the dumbbell 100 including a handle 110 and two heads 120 disposed on opposite sides of the handle 110. The handle 110 extends along a central longitudinal axis 10 that extends through a radial center of dumbbell 100. Handle 110 may have any suitable shape. For example, handle 110 may be generally cylindrical. Handle 110 also may include other shapes, recesses, protrusions, or the like to alter the handle, the feel, and/or the aesthetics of the handle. For example, handle 110 may have other cross-sectional shapes and/or may have a varied thickness or shape along its length. Handle 110 may include a textured grip 115, which may include but is not limited to knurling, polymer or rubberized grips, cast-iron texturing, or other similar textures or materials that provide increased friction for the user. In some embodiments, handle 110 is an exposed handle that does not include any polymer or rubber (e.g., neoprene or other rubber) coating.

The heads 120 may be substantially similar to one another in shape and weight. In an exemplary embodiment, dumbbell 100 may be a hexagonal dumbbell and, thus, heads 120 may each have a generally hexagonal shape. In particular, a cross-section of head 120 taken in a plane perpendicular or orthogonal to the central longitudinal axis 10 may be generally hexagonal in shape. Heads 120 may form a generally equilateral or non-equilateral shape. The terms "hexagon" and "hexagonal" as used herein mean any six-sided polygon structure or shape, including six-sided polygon structures having sides of the same or different dimensions or lengths and the same or different sized angles between adjacent sides. Also, the terms "hexagon" and "hexagonal" as used herein include shapes and/or structures having side edges joined at rounded corners (rather than the more pronounced and sharp corners) provided that the six-sided configuration remains apparent (e.g., relatively straight side edges joined by a rounded corner).

Each head 120 includes an inner end face 130, an outer end face 140 spaced apart from the inner end face 130, and a plurality of side faces 150 disposed longitudinally between the inner end face 130 and the outer end face 140. Inner end face 130 may be disposed closer to a longitudinal center of dumbbell 100 than outer end face 140. Outer end face 140 may be the longitudinally-outermost portion of head 120 and of dumbbell 100. Outer end face 140 and inner end face 130 may each be substantially planar or flat. In other embodiments, outer end face 140 and inner end face 130 may possess some curvature.

Heads 120 each include a plurality of side faces 150. In the hexagonal dumbbell shown in the figures, heads 120 each include six side faces 150, although other suitable numbers are also contemplated in non-hexagonal configurations. For example, three-sided, four-sided, five-sided, eight-sided, ten-sided, twelve-sided, or other configurations are contemplated. In one embodiment, a majority of side faces 150 are substantially planar or flat, although in other embodiments, outer end face 140 and/or inner end face 130 may possess some curvature. In the embodiment shown in FIG. 1, head 120 may include five substantially planar or flat side faces 150, and one side face 150 having an indentation 155 in its outer surface. The indentation 155 may enable a given side face 150 to display a logo and/or weight of the given dumbbell 100. However, even when a given side face 150 includes an indentation 155, such side face 150 may include an outer periphery 158 that is substantially planar of flat, in order to promote the ability of a user to rest the dumbbell 100 on any of its side faces 150. The planar shapes of side faces 150 help prevent dumbbells 100 from rolling.

Adjacent faces of each head 120 are connected to one another along their respective edges at interfaces or rims. In some embodiments, one or more of the rims or edges are rounded or curved, rather than having straight, sharp, or chamfered edges. The interfaces or edges may thus include a curvature extending along their respective lengths. In other words, the intersections 1) between circumferentially adjacent side faces 150 (side rims 180); 2) between a side face 150 and inner end face 130 (inner end rims 160); and 3) between a side face 150 and outer end face 140 (outer end rims 170), are curved surfaces that do not include 1) any sharp or straight edge, and do not include 2) any chamfers. In the exemplary dumbbell 100, each of the heads 120 includes six inner end rims 160 and six outer end rims 170 on opposite sides of the head 120. Each head 120 also includes six side rims 180.

Interfaces, rims, or edges, between two adjacent faces of the dumbbell are round such that they have a radius or curvature. The interfaces, rims, or edges may be round and/or curved, or otherwise contain a fillet or bullnose. Thus, the interfaces are not a straight edges or straight lines formed by the direct intersection of two planar surfaces.

As discussed above, adjacent faces of each head 120 are connected to each other along their respective edges or rims. Each of these edges or rims have a rounded or curved shape, which may be a convex shape when viewed from a perspective exterior of the dumbbell. As stated above, in at least some embodiments, none of the linear faces of the heads 120 (e.g., the inner end face 130, the outer end face 140, or the side faces 150) intersect with another linear face directly at a straight edge, straight line, or straight corner. Furthermore, in some embodiments, none of the faces of the heads 120 are joined by a chamfer.

The radius or curvature of the rounded edges and rounded corners disclosed herein may differ depending on the other dimensions or characteristics of the dumbbell. As is evident from Tables 1 and 2, the various dimensions of similarly constructed dumbbells are varied depending upon the particular weight of the dumbbell.

Figure 4:
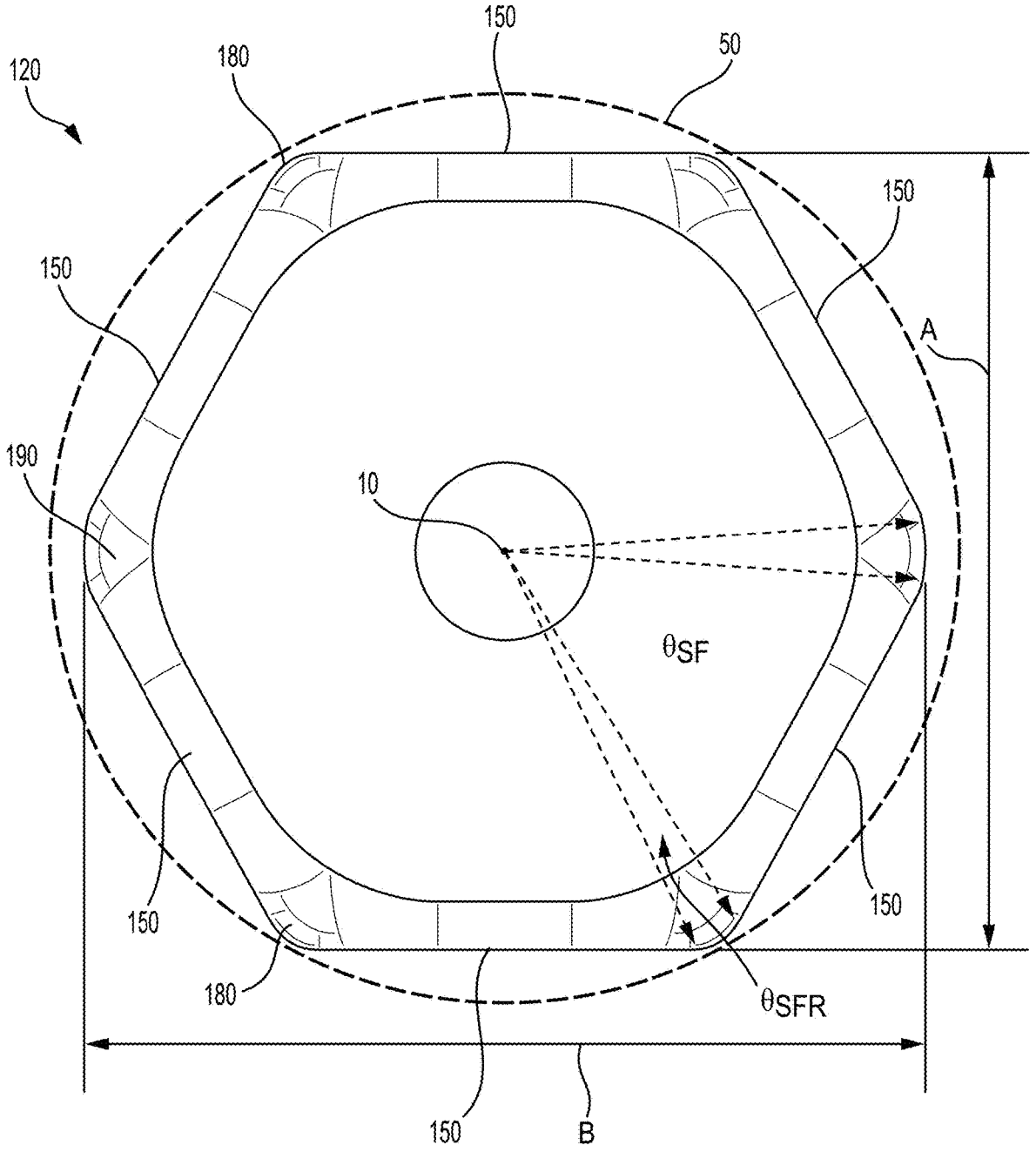
FIG. 4 is a side view of the exemplary dumbbell.

FIG. 4 illustrates a side view of the exemplary dumbbell head 120, the head 120 including the plurality of side faces 150 and side rims 180. The figure includes a center point that is coaxial with the central longitudinal axis 10 and a polar reference axis 50 which circumscribes the head 120. Each side face 150 of the weighted ends 120 may be equilateral and result in side face angles, $\theta_{SF}$, of equal size. Similarly, each of the plurality of side rims 180 have a resulting side rim angle, $\theta_{SFR}$, of equal size, measured between the center point and the opposing sides of the side rim 180. According to one embodiment, the range of the side rim angle, $\theta_{SFR}$, could be from about 3 degrees to about 15 degrees. In other embodiments, the side rim angle, $\theta_{SFR}$ may be from about 5 degrees to about 12 degrees, from about 6 degrees to about 10 degrees, from about 7 degrees to about 9 degrees, or about 8 degrees.

Figure 5:
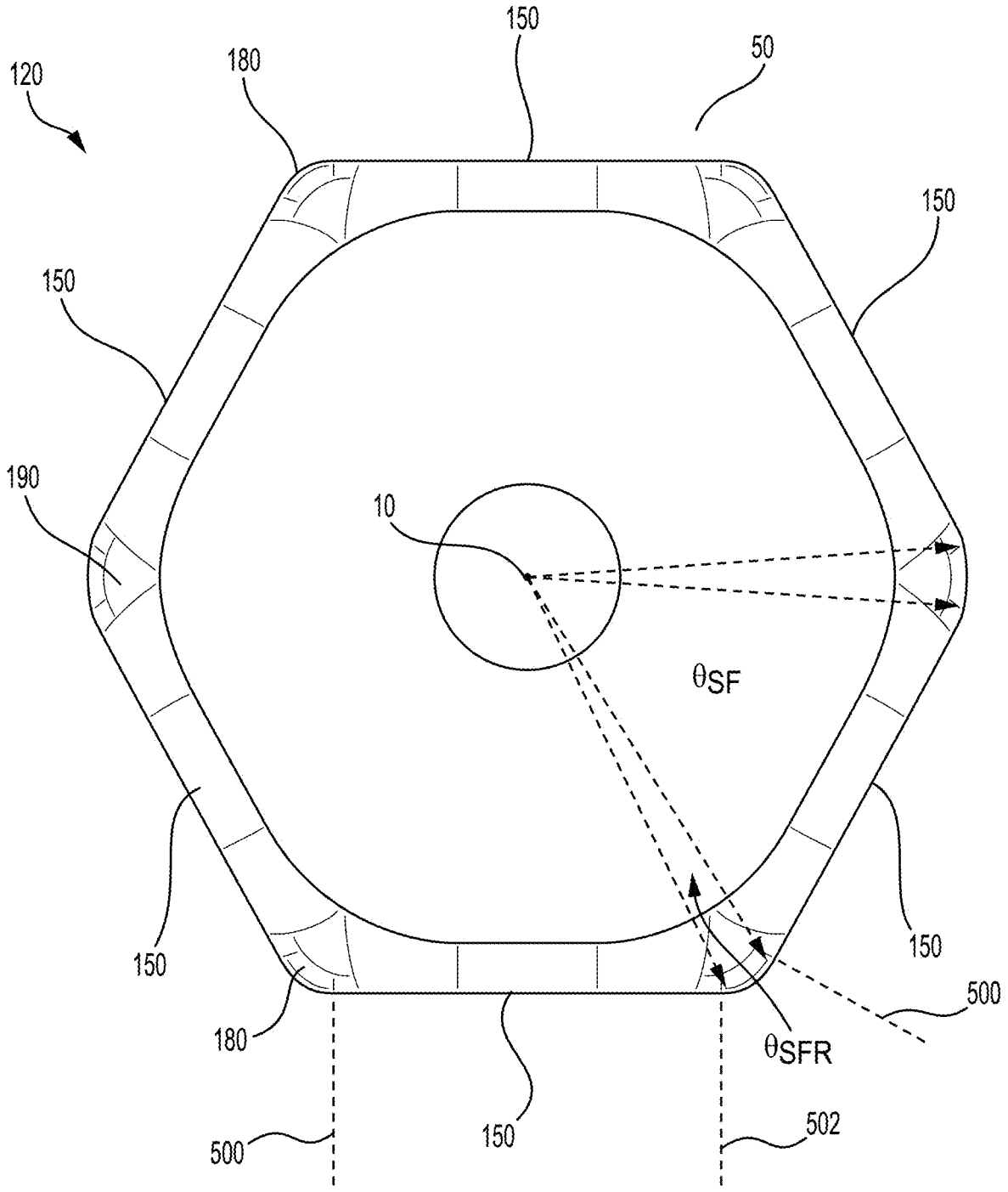
FIG. 5 is another side view of the exemplary dumbbell.

Referring to FIG. 5, the arc length for a given side rim 180 may be measured between a tangent 500 of one side face 150, and a tangent 502 on a circumferentially adjacent side face 150, wherein tangent 500 and tangent 502 represent the points where a given side face 150 transitions from being substantially linear to exhibiting the curvature of a side rim 180.

As shown in FIGS. 1-4, each head 120 includes a plurality of rim intersections or corners 190 where at least three rims converge. For example, an intersection corner 190 may be formed by either 1) the intersection of two rims 160 and a side rim 180, or the intersection of two rims 170 and a side rim 180. For example, in an instance where an inner end rim 160 converges with two side rims 180, the intersection point will result in a corner 190 in proximity to the handle 110. Similarly, in an instance where an outer end rim 170 converges with two side rims 180, the intersection point will result in a rim intersection 190 on the outer periphery of the head 120. Due to the various curvatures of each rim 160, 170, and 180, corners 190 are blunt. The blunt shape of corners 190 are in contrast to the sharp corners found in dumbbells where corners are formed by the intersection of straight or chamfered edges. The blunt shape of corners 190 increase user comfort during exercises where dumbbell 100 is rested or pressed onto the body (e.g., front squats, push presses, farmer carries, and the like).

Dumbbell 100 may include a metal (e.g., cast iron or steel) forming handle 110 and the interior of heads 120. In some examples, heads 120 may be welded to handle 110. Heads 120 may then be covered with a rubber coating. Any suitable rubber may be used, such as, for example synthetic or natural rubbers. In the dumbbell shown in FIGS. 1-5, only heads 120 include the rubber coating such that handle 110 comprises exposed metal. However, it is contemplated in some embodiments, that handle 110 may also include some rubber coating.

Figure 2:
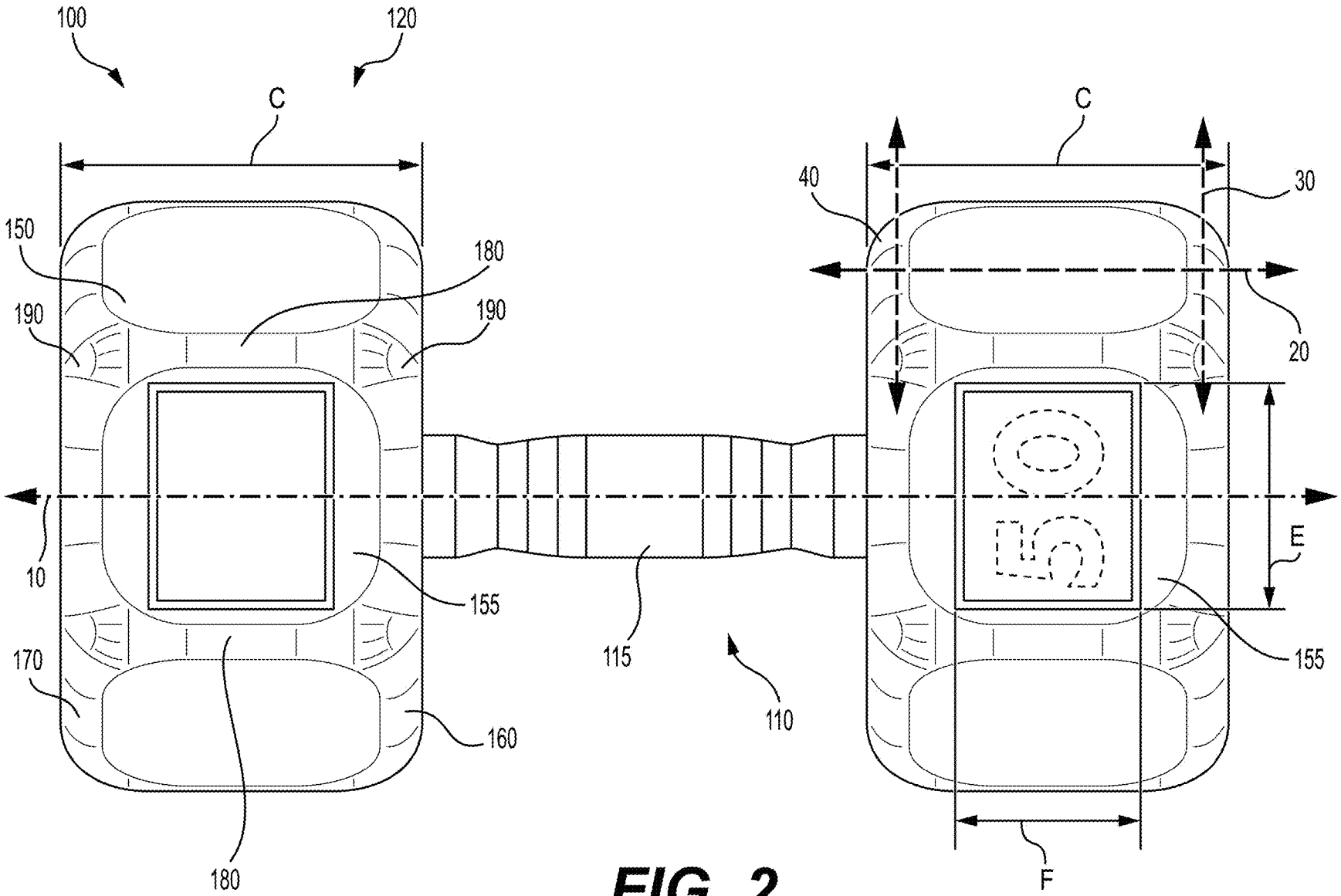
FIG. 2 is a top view of the exemplary dumbbell.
Figure 3:
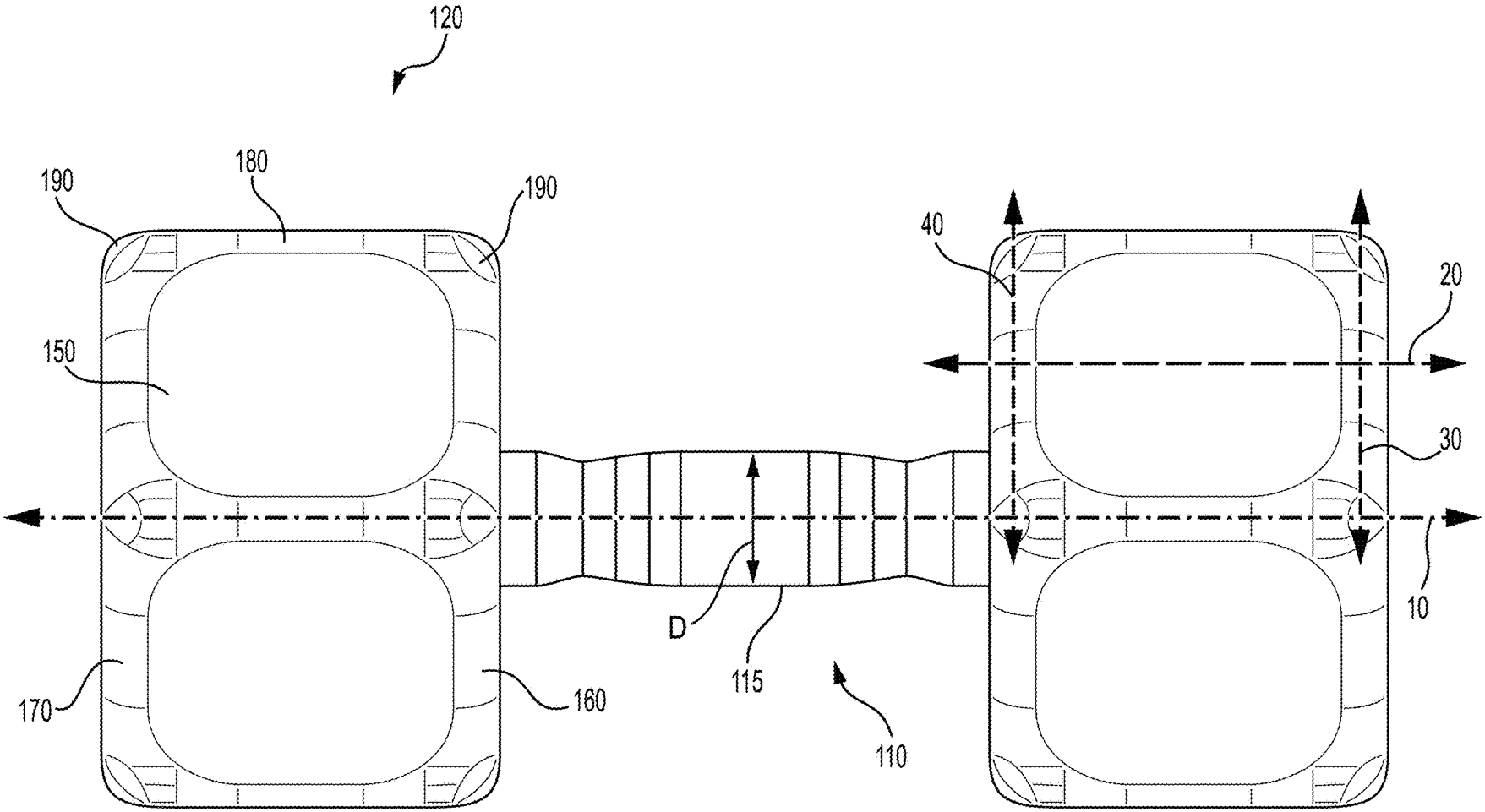
FIG. 3 is a front view of the exemplary dumbbell.

As shown in the FIGS. 2-4, the exemplary dumbbell 100 may be defined by a plurality of dimensions based on the size or weight of the dumbbell itself. For example, the handle 110 is defined by a maximum diameter D, while the heads 120 each have a height A, a width B, and a length C. In order to distinguish between dumbbells of similar size but different weights, each head 120 may have indicia identifying the weight of the given dumbbell on a side face 150. Exemplary measurements for the various dimensions A-F (in millimeters) may be found in Table 1 (for dumbbells ranging from 5 lbs. to 65 lbs.) and Table 2 (for dumbbells ranging from 70 lbs. to 100 lbs.) below.

TABLE 1

Exemplary dimensions for dumbbells ranging from 5 lbs. to 65 lbs. (in mm)

| Weight | A | B | C | D | E | F |
|---|---|---|---|---|---|---|
| 5 LB | 74 | 83 | 51.7 | 28 | 26 | 20 |
| 7.5 LB | 87 | 97.8 | 60.5 | 28 | 31 | 24 |
| 10 LB | 95 | 107 | 67.2 | 28 | 37 | 27 |
| 12.5 LB | 102 | 115 | 72 | 28 | 39 | 30 |
| 15 LB | 106 | 119.5 | 79.8 | 34 | 40 | 35 |
| 17.5 LB | 111 | 125 | 83.5 | 34 | 42.5 | 35 |
| 20 LB | 116 | 130.5 | 85.5 | 34 | 45 | 35 |
| 22.5 LB | 122 | 137.4 | 88 | 34 | 47.5 | 37.5 |
| 25 LB | 128 | 144 | 91 | 34 | 50 | 40 |
| 30 LB | 133 | 150 | 98 | 34 | 53 | 42.5 |
| 35 LB | 138 | 155.5 | 105 | 34 | 55.5 | 45 |
| 40 LB | 143 | 161 | 108.5 | 34 | 58.5 | 48 |
| 45 LB | 148 | 167 | 113.3 | 34 | 61 | 50.5 |
| 50 LB | 153 | 172.5 | 119.7 | 34 | 64 | 53 |

TABLE 1-continued

Exemplary dimensions for dumbbells ranging from 5 lbs. to 65 lbs. (in mm)

| Weight | A | B | C | D | E | F |
|---|---|---|---|---|---|---|
| 55 LB | 158 | 178 | 121.3 | 34 | 66 | 55 |
| 60 LB | 163 | 184 | 125 | 34 | 68 | 57 |
| 65 LB | 168 | 189.5 | 126.5 | 34 | 70 | 59 |

TABLE 2

Exemplary dimensions for dumbbells ranging from 70 lbs. to 100 lbs. (in mm)

| Weight | A | B | C | D | E | F |
|---|---|---|---|---|---|---|
| 70 LB | 173 | 195 | 128 | 37 | 71 | 60 |
| 75 LB | 178 | 200.5 | 130 | 37 | 71.5 | 60.5 |
| 80 LB | 182 | 205 | 132 | 37 | 72.5 | 61.5 |
| 85 LB | 186 | 209.8 | 135 | 37 | 74 | 62.5 |
| 90 LB | 190 | 214.4 | 137.5 | 37 | 75.5 | 64 |
| 95 LB | 194 | 218.5 | 140.5 | 37 | 77.5 | 65.5 |
| 100 LB | 197 | 222 | 142.5 | 37 | 78.5 | 66.5 |

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

The invention claimed is:

1. A dumbbell comprising:

an exposed metal handle having a central longitudinal axis extending through the handle; and two heads located at opposite ends of the handle, each of the heads including:

an outer end face;

an inner end face positioned closer to the handle than the outer end face;

a plurality of side faces disposed between the outer end face and the inner end face, each of the plurality of side faces facing radially outward away from the central longitudinal axis; and a plurality of rims, wherein one of the plurality of rims is disposed at each interface of:

a) the outer end face and each of the plurality of side faces of a given head;

b) the inner end face and each of the plurality of side faces of a given head; and c) circumferentially adjacent side faces, wherein each rim of the plurality of rims includes a fillet, and wherein, an arc length of each rim of the plurality of rims is from about 3-15 degrees, wherein the arc length is measured about a polar axis, wherein the polar axis has a center point along a central longitudinal axis extending through the handle and the two heads.

2. The dumbbell of claim 1, wherein the two heads of the dumbbell do not include any straight edges at the interface of:

a) the outer end face and each of the plurality of side faces of a given head;

b) the inner end face and each of the plurality of side faces of a given head; and c) circumferentially adjacent side faces.

3. The dumbbell of claim 1, wherein each of the two heads includes a metal core, and a rubber cover, wherein the plurality of rims are formed in the rubber cover of a given head.

4. The dumbbell of claim 1, wherein the outer end face and the inner end face are substantially planar.

5. The dumbbell of claim 1, wherein each head includes six side faces.

6. The dumbbell of claim 1, wherein each head includes a substantially hexagonal cross-section.

7. The dumbbell of claim 1, wherein the arc length of each rim is measure between a first tangent to a first side face of the plurality of side faces, and a second tangent to a second side face of the plurality of side faces, wherein the first side face and the second side face are circumferentially adjacent to one another.

8. The dumbbell of claim 1, wherein the outer end face and the inner end face are substantially planar.

9. The dumbbell of claim 1, wherein a majority of the plurality of side faces are substantially planar.

10. The dumbbell of claim 1, wherein for each of the two heads, one of the plurality of side faces includes an indentation.

11. The dumbbell of claim 1, wherein rounded corners are disposed at the interface of two circumferentially adjacent side faces and the outer end face.

12. The dumbbell of claim 1, wherein rounded corners are disposed at the interface of two circumferentially adjacent side faces and the inner end face.

13. The dumbbell of claim 1, wherein each head includes twelve rounded corners.

14. The dumbbell of claim 1, wherein each head of the dumbbell does not include any sharp corners.

15. The dumbbell of claim 1, wherein the dumbbell has a weight of at least 5 pounds.

16. The dumbbell of claim 1, wherein the dumbbell has a weight of at least 25 pounds.

17. The dumbbell of claim 1, wherein the dumbbell has a weight from 35 pounds to 100 pounds.

18. A dumbbell comprising:

an exposed metal handle having a central longitudinal axis extending through the handle; and two heads located at opposite ends of the handle, each of the heads including:

an outer end face, an inner end face positioned closer to the handle than the outer end face, and a plurality of side faces disposed between the outer end face and the inner end face forming a plurality of interfaces, each of the plurality of side faces facing radially outward away from the central longitudinal axis, wherein each of the following interfaces within each of the two heads includes a rounded edge:

a) the outer end face and each of the plurality of side faces of a given head;

b) the inner end face and each of the plurality of side faces of a given head; and c) circumferentially adjacent side faces, and wherein, an arc length of each of the interfaces within each of the two heads is from 3-15 degrees, wherein the arc length is measured about a polar axis, wherein the polar axis has a center point along a central longitudinal axis extending through the exposed metal handle and the two heads.

19. A dumbbell comprising:

an exposed metal handle having a central longitudinal axis extending through the handle; and two rubber-coated heads located at opposite ends of the handle, wherein each head includes six outer side faces extending around a circumference of the given head, and no interface between circumferentially adjacent faces has a straight edge or straight corner, wherein the two rubber-coated heads each include at least one rim disposed between at least two circumferentially adjacent faces, and wherein the at least one rim has an arc length from 3-15 degrees, wherein the arc length is measured about a polar axis, and wherein the polar axis has a center point along a central longitudinal axis extending through the handle and the two heads.

* * * * *